US005579021A

United States Patent [19]

Lee

[11] Patent Number: 5,579,021

[45] Date of Patent: Nov. 26, 1996

[54] SCANNED ANTENNA SYSTEM

[75] Inventor: Jar J. Lee, Irvine, Calif.

[73] Assignee: Hughes Aircraft Company, Los Angeles, Calif.

[21] Appl. No.: 405,646

[22] Filed: Mar. 17, 1995

[51] Int. Cl.[6] ..... H01Q 13/00

[52] U.S. Cl. ..... 343/781 P; 343/781 R; 343/779; 343/780

[58] Field of Search ..... 343/754, 711, 343/761, 772, 780, 781 R, 781 P, 781 CA, 839; 333/21 R

[56] References Cited

U.S. PATENT DOCUMENTS

| | | | |
|---|---|---|---|
| 2,478,241 | 7/1945 | Chu | 343/781 |
| 2,589,433 | 3/1952 | Riblet | 343/780 |
| 3,795,004 | 2/1974 | Meek et al. | 343/781 CA |
| 3,936,837 | 2/1976 | Coleman et al. | 343/781 R |
| 4,410,892 | 10/1983 | Knop et al. | 343/781 R |
| 4,829,315 | 5/1989 | Cookman | 343/772 |
| 4,939,526 | 7/1990 | Tsuda | 343/781 R |
| 5,266,961 | 11/1993 | Milroy et al. | 343/772 |

OTHER PUBLICATIONS

Silver, Samuel, *Microwave Antenna Theory and Design*, McGraw–Hill Publishing, New York, 2nd Edition, 1984, pp. 457–464 no month.

*Primary Examiner*—Donald T. Hajec
*Assistant Examiner*—Tan Ho
*Attorney, Agent, or Firm*—Leonard A. Alkov; Wanda K. Denson-Low

[57] ABSTRACT

Compact, microwave scanned antennas include combinations of a radiator, a reflector and a mirror. The radiator is formed by plating a shaped dielectric core. It generates an antenna beam at an output aperture in response to a microwave signal at an input port. The wavefront orientation of the antenna beam is a function of the wavefront orientation of the microwave signal at the input port. Changing the angular relationship between the path of the microwave signal and the input port changes the wavefront orentation of the antenna beam and, therefore, its beam axis. Pivoting the reflector realizes the desired angular change in the microwave signal path. Alternatively, the reflector can be fixed and the mirror pivoted to vary the microwave signal path. Antenna embodiments can be physically realized with a single moving part, the shaped dielectric is easy to form and when configured to operate at a high frequency, e.g., 77 GHz, the antenna is small enough to fit behind an automobile license plate.

28 Claims, 9 Drawing Sheets

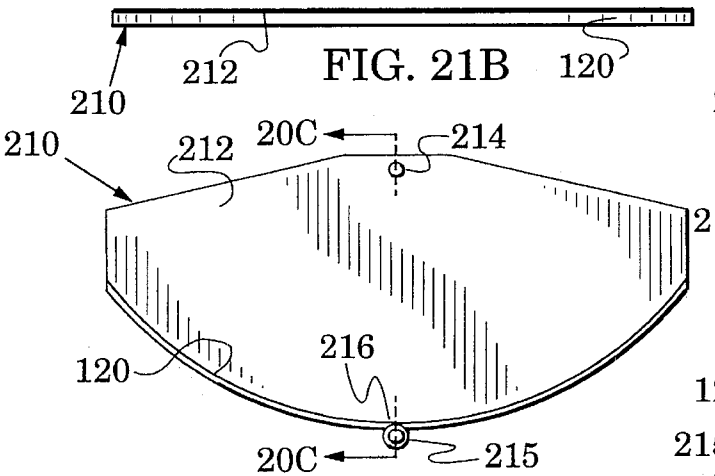
FIG. 21C
FIG. 21B
FIG. 21A
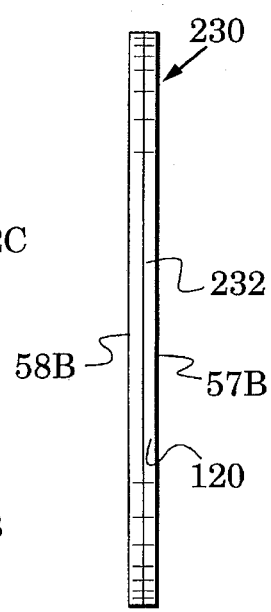
FIG. 22B
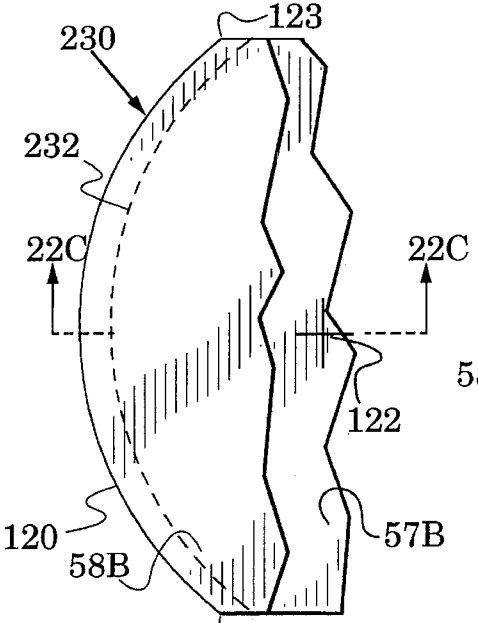
FIG. 22A
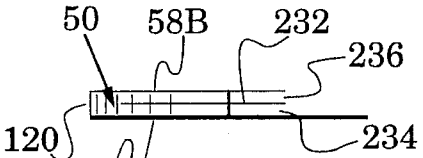
FIG. 22C

SCANNED ANTENNA SYSTEM

BACKGROUND OF THE INVENTION

1. Field of the Invention

The present invention relates generally to microwave antennas.

2. Description of the Related Art

There is a growing commercial denhand for low-cost radar systems. For example, investigators around the world are working on the development of collision-avoidance radar systems for use in automobiles, trucks, boats and small aircraft. A key element of these radar systems is an antenna that can radiate a scanned microwave beam. Obstacles that are interrogated by the scanned beam cause an echo which is received by the antenna and sent to an electronic portion of the radar for processing.

If a collision-avoidance radar is to be commercially viable, its elements, such as the scanned antenna, must be light weight, low cost, spatially compact and offer good performance with low maintenance costs over a long lifetime (e.g., >10 years). In addition, the scanned antenna should preferably be based on technologies that are well developed so as to reduce technical and schedule risks.

Apparatus for scanning a microwave antenna beam have generally fallen into two groups, mechanically-scanned antennas and electronically-scanned antennas. Gimbal systems have been extensively used in aircraft to facilitate the mechanical scanning of fixed-beam antennas. However, gimbal systems are typically heavy and costly to ihbricate and usually require considerable maintenance.

Electronic scanning has often achieved high peribrmance but at the cost of complexity, weight and cost. For example, antennas have incorporated movable waveguide vanes which vary the phase of radiation through waveguide slots (e.g., see Markus, John, et al., McGraw-Hill *Electroncis Dictionary,* McGraw-Hill, New York, 5th Edition, 1994, p. 390). These systems involve a large number of moving parts so that both fabrication and maintenance costs tend to be high. Phased array antennas typically employ a plurality of phase shifters, e.g., ferrite and electronic, to provide beam steering (e.g., see Stimson, George W., *Introduction to Airborne Radar,* Hughes Aircraft Company, El Segundo, 1983, pp. 577–580). Phased arrays can achieve high-speed scanning but the phase shifters and associated parts, e.g., waveguide networks and amplifiers, result in complex fabrication and high parts count.

SUMMARY OF THE INVENTION

The present invention is directed to a simple, light-weight, compact, low-cost scanned antenna which offers the prospect of low maintenance over a long lifetime.

The antenna includes a radiator which is preferably formed with plating on a shaped dielectric to define a parallel-plate waveguide and a plurality of transverse stubs that issue from the waveguide. One edge of the waveguide forms an input port and the transverse stubs form an output aperture. A microwave signal inserted into the input port is converted to an antenna beam at the output aperture wherein the wavefront orientation of the antenna beam is a function of the wavefront orientation of the microwave signal at the input port. Changing the angular relationship between the path of the microwave signal and the input port changes the wavefront orientation of the antenna beam and, therefore, its beam axis.

The parallel-plate waveguide is extended to contain a reflector which preferably has a parabolic shape to reflect a collimated microwave signal with a transverse wavefront. Pivoting the reflector realizes the desired changes in the microwave signal path. Alternatively, the reflector can be fixed and a pivoted mirror is used to vary the orientation of the microwave signal path.

In accordance with a feature of the invention, the wavefront produced by the reflector is a continuous wavefront whose energy density approximates a cosine function. This wavefront is especially suited for illuminating the radiator because it will produce an antenna beam that has low side-lobe power.

In an antenna embodiment, the parallel-plate waveguide is folded to place the antenna elements back-to-back and, thereby, reduce the spatial volume of the antenna.

Antenna embodiments can be physically realized with a single moving part, the shaped dielectric is easy to form and when the antenna is configured to operate at a high frequency, e.g., 77 GHz, it is small enough to fit behind an automobile license plate.

BRIEF DESCRIPTION OF THE DRAWINGS

FIG. 21A is front elevation view of a reflector in the scanned antenna of FIG. 18;

FIG. 21B is a top plan view of the reflector of FIG. 21A;

FIG. 21C is a side elevation view of the reflector of FIG. 21A;

FIG. 22A is a front elevation view of another reflector embodiment;

FIG. 22B is a side elevation view of the reflector of FIG. 22A; and

FIG. 22C is a bottom plan view of the reflector of FIG. 22A.

DESCRIPTION OF THE PREFERRED EMBODIMENTS

Figure 1:
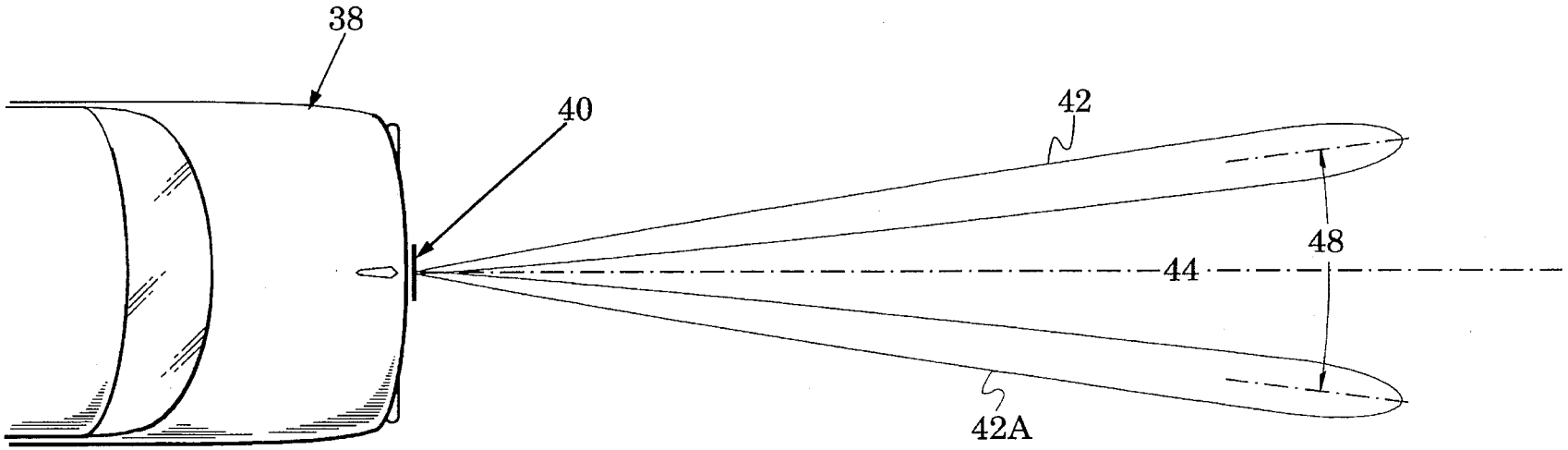
FIG. 1 is a plan view of a vehicle with a scanned antenna in accordance with the present invention.
Figure 2:
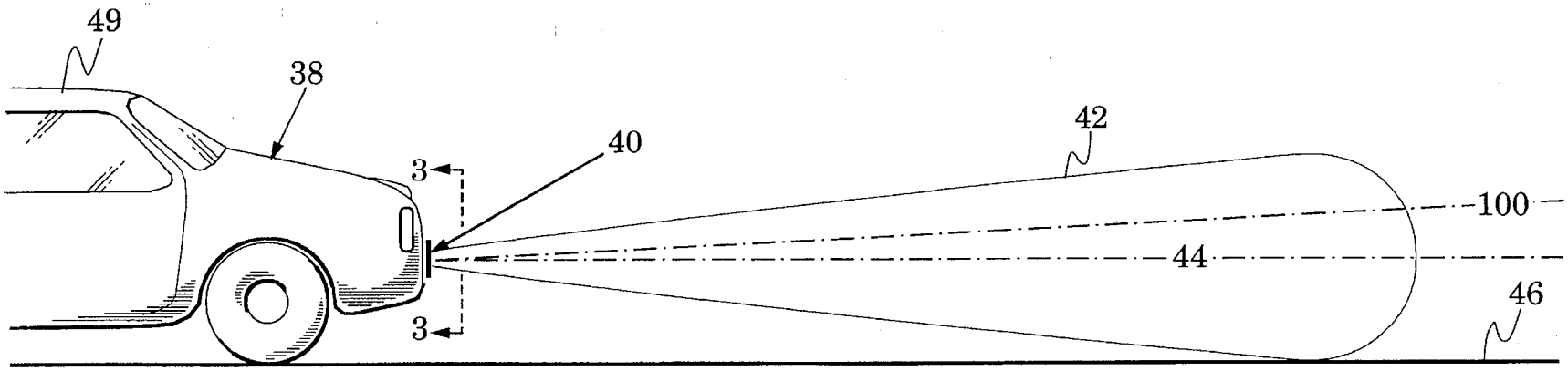
FIG. 2 is an elevation view of the vehicle and scanned antenna of FIG. 1.

FIGS. 1 and 2 illustrate a motor vehicle 38 which has a scanned, antenna 40 in accordance with the present invention. The scanned antenna 40 is mounted approximately in the region of the vehicle's front license plate and radiates an antenna beam 42 forward from the vehicle 38. The scanned antenna 40 has a mechanical boresight 44 (an axis which is substantially orthogonal with the radiating face of the antenna).

In operation of the scanned antenna 40, the beam 42 is scanned in the antenna's azimuth plane (a plane through the boresight 44 which is parallel with the road surface 46) over a scan angle 48, e.g., 15°. Preferably, the beam 42 does not move in the antenna's elevation plane (a plane through the boresight 44 which is orthogonal to the road surface 46). The angular beam width in the elevation plane is preferably restricted to reduce echoes from the road surface 46. On the other hand, the elevation beam width is preferably sufficient to produce echoes from objects that could strike the roof 49 of the vehicle 38.

Figure 4:
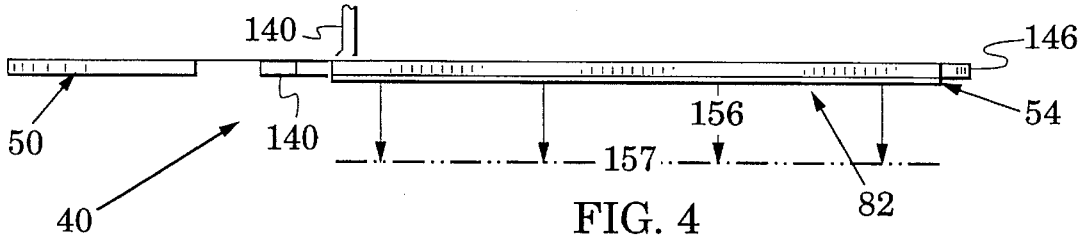
FIG. 4 is a top plan view of the scanned antenna of FIG. 3; this view shows a radiation wavefront with the antenna mirror in the first position of FIG. 3.
Figure 3:
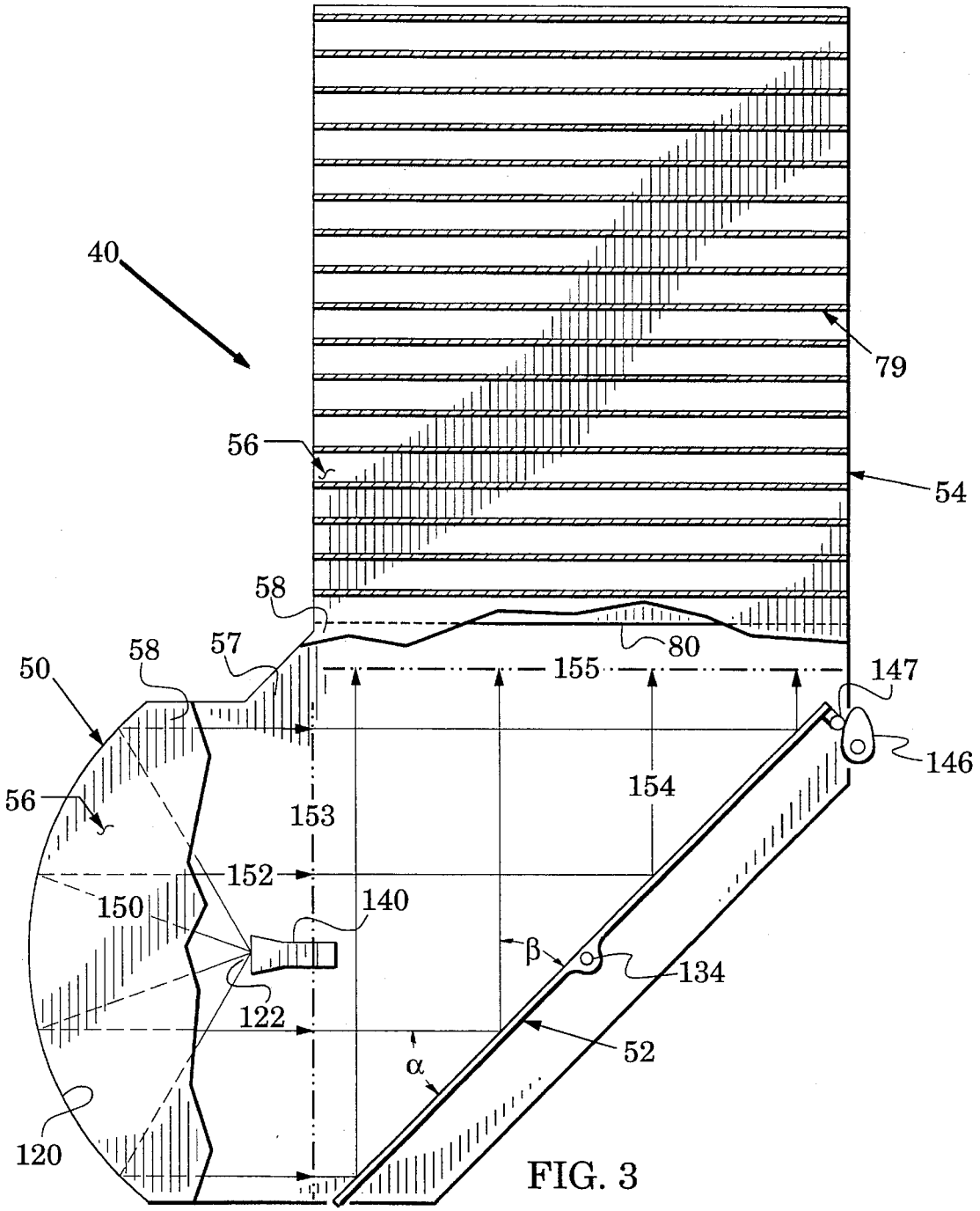
FIG. 3 is an enlarged view along the plane 3—3 of FIG. 2 which illustrates a front elevation of the scanned antenna of FIGS. 1 and 2; in this view, one side of a parallel plate waveguide is partially removed to show a mirror in a first position.
Figure 6:
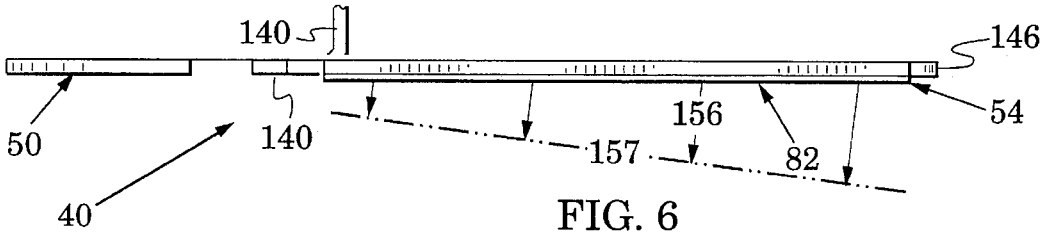
FIG. 6 is a view similar to FIG. 4 showing the radiation wavefront with the antenna mirror in the second position.

FIG. 3 shows the scanned antenna 40 as it would appear along the plane 3—3 of FIG. 2 and FIG. 4 is a top plan view of the scanned antenna 40. The antenna 40 includes a parabolic reflector 50, a pivotable mirror 52 and a radiator 54. The reflector 50 and radiator 54 are integrated within the structure of a parallel-plate waveguide 56 which has a lower plate 57 and an upper plate 58. In FIG. 3, the upper plate 58 is partially removed for clarity of illustration. Between the reflector 50 and the radiator 54, the parallel-plate waveguide 56 guides and contains microwave radiation that is redirected by the mirror 52.

A description of the structure and operation of the scanned antenna 40 is facilitated if the detailed structure of the reflector 50, mirror 52 and radiator 54 are understood. Accordingly, these elements will first be described with reference to FIGS. 7A–D, 8, 9A–9C, 10A–10B and 11A–11B. After this description of antenna elements, attention will be returned to the scanned antenna 40 of FIGS. 3 and 4 and its operation.

The radiator 54 is illustrated in FIGS. 7A–7D. The radiator 54 has a core 62 which is formed of a low-loss dielectric (e.g., Rexolite which has a loss tangent of ~0.0003). The core 62 includes a rectangular panel 64 that has a height 66 and a width 68. As detailed in FIG. 7C, the core 62 also includes a plurality of parallel ribs 70 which extend orthogonally from one side of the panel 64. The ribs 70 have sides 72 which terminate at a face 74.

The broad sides of the panel 64 are plated with a metal, e.g., copper, which forms a pair of spaced, parallel plate portions 57A and 58A. The plate portions 57A and 58A are parts of the lower and upper plates 57 and 58 of FIG. 3. A variety of fabrication techniques can be employed to form the complete plates 57 and 58. For example, the portion of these plates that extends over the mirror 52 and the reflector 50 in FIG. 3 can be formed separately and then joined, e.g., by brazing, to the plate portions 57A and 58A that are plated onto the panel 64.

Figure 7A:
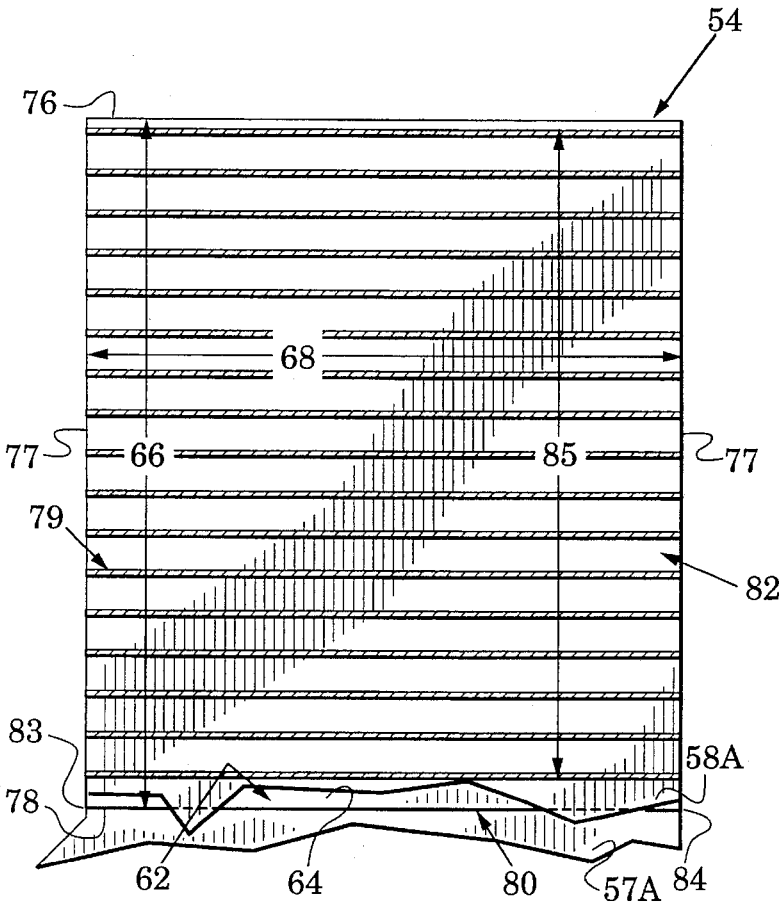
FIG. 7A is a front elevation view of a radiator in the scanned antenna of FIG. 3.
Figure 7B:
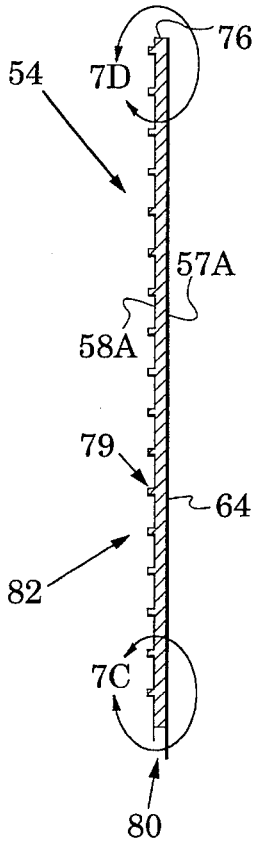
FIG. 7B is a side elevation view of the radiator of FIG. 7A.

The sides 72 of the ribs 70 are also metallically plated as is the top edge 76 of the panel 64. The face 74 of the ribs 70 and the panel's side edges 77 and bottom edge 78 are not plated. The exposed, unplated surfaces of the core 62 (which are the faces 74, the panel side edges 76 and the panel bottom edge 78) are cross-hatched for clarity of illustration. The panel 64 and its plates 57A and 58A form a parallel-plate waveguide (a portion of the parallel-plate waveguide 56 of FIG. 3). The ribs 70 and their plated sides 72 form transverse stubs 79 which protrude outward from the plate portion 58A. As seen in FIG. 7A, the transverse stubs 79 extend between the panel's side edges 77.

The structure of the radiator 54 forms an input port 80 and an output aperture 82. The input port 80 is the lower panel edge 78 which is confined between the lower and upper plate portions 57A and 58A and which extends across the panel 64 from one port side 83 to another port side 84 (shown in FIG. 7A). The output aperture 82 is formed by the plurality of transverse stubs 79. An aperture is the radiating area of an antenna and the aperture 82, therefore, has, in FIG. 7A, a width 68 and a height 85. The mechanical boresight 44 that is indicated in FIGS. 1 and 2 is an axis that extends orthogonally from the center of the radiator's aperture, i.e., it extends orthogonally from a point on the panel 64 that is centered in the aperture width 68 and height 85.

Figure 7C:
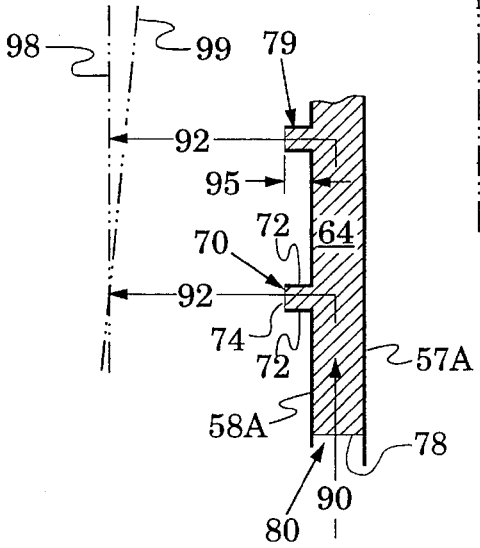
FIG. 7C is an enlarged view of the structure within the curved line 7C of FIG. 7B.

In operation of the radiator 54, a microwave signal 90 is inserted into the input port 80 as shown in FIG. 7C. The microwave energy travels up the waveguide formed between the parallel plates 57A and 58A. At each transverse stub 79, a portion 92 of the energy is conducted between the plated rib sides 72 and radiated outward (across the rib face 74) orthogonally from the panel 64. The microwave energy continues upward in the panel 64 until it supplies the last transverse stub 79 (the stub that is adjacent the top panel edge 76). To reduce energy reflections from the top edge 76 of the radiator, the end of the parallel-plate waveguide is preferably filled with a load 94 which is formed from an energy-absorbent material. The energy portions 92 combine to form the antenna beam 42 that is illustrated in FIGS. 1 and 2. The height 95 of the ribs 70 can be adjusted to enhance the impedance match between free space and the parallel-plate waveguide that is formed by the plates 57A and 58A.

Figure 7D:
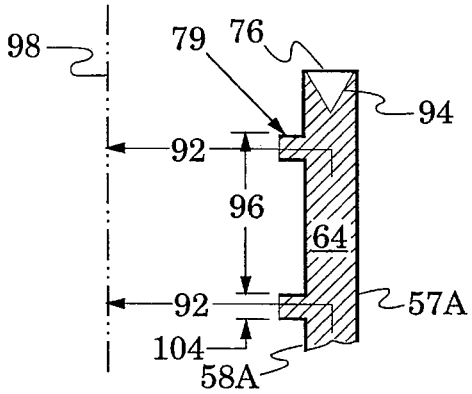
FIG. 7D is an enlarged view of the structure within the curved line 7D of FIG. 7B.
Figure 8:
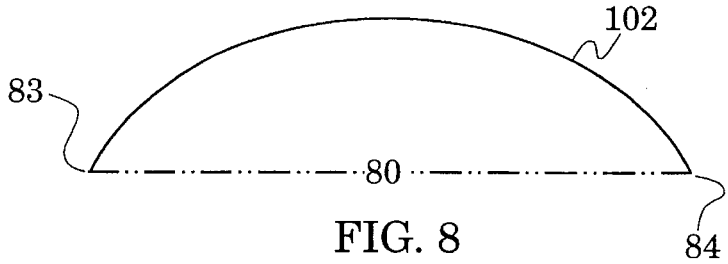
FIG. 8 is a graph of a preferred energy density distribution for illuminating an input port of the radiator of FIGS. 7A–7D.

The guide wavelength $\lambda_g$ of the microwave energy within the radiator 54 is a function of the dielectric constant of the core 62 and the physical guide dimensions. If the spacing 96 (shown in FIG. 7D) of the transverse stubs 79 is an integer number of wavelengths $\lambda_g$, then the energy issuing from each transverse stub 79 is in phase and the wavefront 98 (a wavefront is a radiation surface of constant phase; it is indicated in FIGS. 7C and 7D) of the antenna beam will be parallel with the panel 64. Because an antenna beam (42 in FIGS. 1 and 2) is always orthogonal with its microwave wavefront, the beam's axis will then be parallel with the antenna's mechanical boresight (44 in FIGS. 1 and 2) in the elevation plane.

The wavefront can be tilted, in the radiator's elevation plane, by fabricating the radiator with other spacings 96. For example, if the spacing 96 is fabricated to be greater than an integer number of wavelengths $\lambda_g$, a tilted wavefront 99 will be realized as indicated in FIG. 7C. The tilted wavefront will cause the beam axis to tilt upward in the elevation plane, e.g., to the axis 100 that is shown in FIG. 2. This elevation tilting can be used to adjust the vertical orientation of the beam 42 to reduce reflections from the road surface 46 and to insure detection of overhead objects that might damage the vehicle roof 49.

The radiated power distribution along the radiator's elevation plane can be controlled by adjusting the width 104 (shown in FIG. 7D) of each transverse stub 79. The energy of the input signal 90 (in FIG. 7C) declines as it flows upward past the transverse stubs 79 because a portion of it is radiated from each stub. To cause the power of the radiation 92 from each stub 79 to be substantially constant, the width 104 preferably increases monotonically from the stub nearest the input port 80 to the stub nearest the panel top edge 76.

Thus, the radiator 54 radiates, in response to a microwave signal 90 that is received at its input port 80, an antenna beam from its output aperture 82 which has a wavefront 98. The movement of the beam's wavefront in the radiator's azimuth plane will be described as part of the operational description of the scanned antenna 40.

The radiator 54 belongs to a type of microwave structure generally known as continuous transverse stubs (CTS). CTS structures are described in detail in U.S. Pat. No. 5,266,961 which issued Nov. 30, 1993 and was assigned to Hughes Aircraft Company, the assignee of the present invention.

To enhance the formation of a well-shaped antenna beam (e.g., low side-lobe energy), the input signal energy at the input port 80 is preferably distributed in accordance with a cosine function. In particular, the energy density along the azimuth plane of the port 80 should approximate the density distribution 102 in FIG. 8. The distribution 102 is shown in this figure to have a peak energy density at the center of the input port 80 and a density which falls away to zero at the port sides 83 and 84. Because the structure of the radiator 54 is open at the side edges 76 of the panel 64, this distribution also reduces the amount of energy that leaks from the open panel edges 77 in FIG. 3. A microwave absorbent material can be positioned along the panel edges 77 to further reduce this microwave leakage.

The input port 80 of FIGS. 7A–7D has a narrow aspect ratio which is defined by the spacing between the plates 57A and 58A and the lateral extent between the port sides 83 and 84. Microwave sources that can form a signal whose shape corresponds to such a narrow input port are typically known as "line sources". Therefore, the port 80 is preferably illuminated by a line source which generates a microwave energy distribution that approximates the distribution 102 of FIG. 8.

Figure 9A:
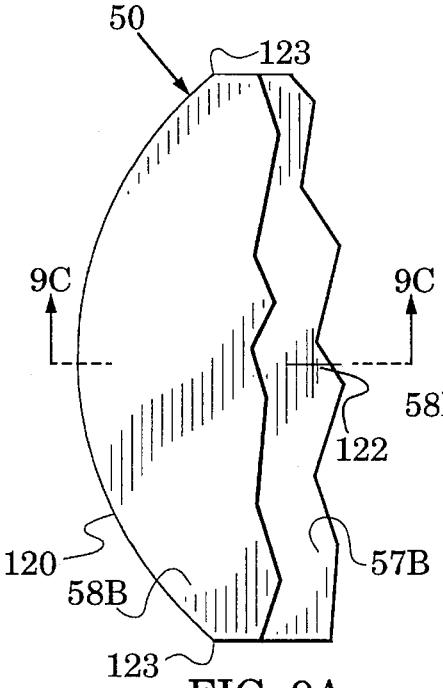
FIG. 9A is a front elevation view of a reflector in the scanned antenna of FIG. 3.
Figure 9B:
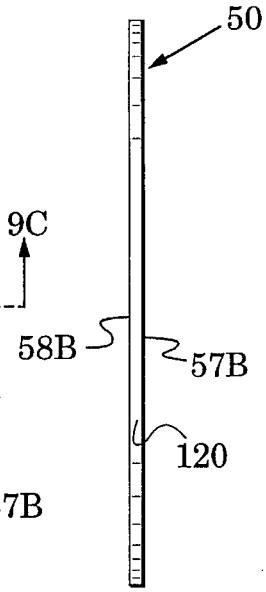
FIG. 9B is a side elevation view of the reflector of FIG. 9A.
Figure 9C:
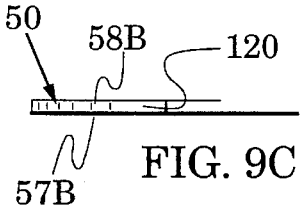
FIG. 9C is a bottom plan view of the reflector of FIG. 9A.

FIGS. 9A–9C illustrate a reflector 50 which is particularly suited for forming a microwave, line source signal which can illuminate the input port 80 of the radiator 54. The reflector 50 includes portions 57B and 58B of the parallel-plate waveguide 56 of FIG. 3. These portions are terminated in an end wall 120 which is shaped as a thin, parabolic cylinder which has a focus 122.

Because of the properties of a parabolic surface, microwave energy that is directed at the end wall 120 from its focus 122 will be reflected as collimated energy, i.e., energy in which the reflected rays are parallel. In addition, the reflected energy from the parabolic surface will decline towards each side edge 123. If the distance between the side edges 123 is designated as d and the focal length of the parabolic wall 120 (distance from the wall to the focus 122) is designated as f, then the reflected energy at the edges 123 can be controlled by a suitable selection of the ratio f/d. For example, in practice the ratio f/d is often set at 0.4. With this ratio, the energy density at the reflector edges 123 will be 10–20% of the power density at the center of the parabola. Thus, the reflected energy distribution can be shaped to approximate the desired energy distribution of FIG. 8. Microwave structures similar to that of the reflector 50 are typically referred to as a "pillbox antennas" (e.g., see Silver, Samuel, *Microwave Antenna Theory,* McGraw-Hill Publishing, New York, 2nd Edition, 1984, pp. 457–464).

Figures 10A, 10B:
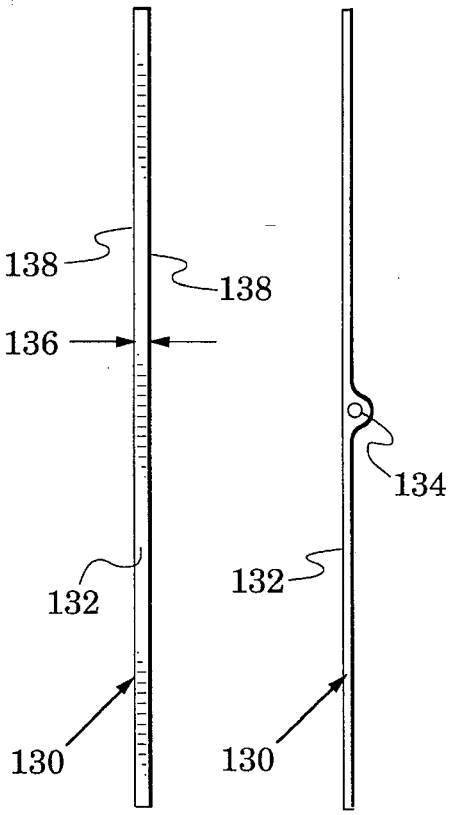
FIG. 10A is a side elevation view of a mirror in the scanned antenna of FIG. 3.
FIG. 10B is a front elevation view of the mirror of FIG. 10A.

FIGS. 10A–10C illustrate a mirror 130 having a face 132 and a pivot bore 134. The mirror 130 has a thickness 136 that allows it to be closely received within the parallel-plate waveguide 56 of FIG. 3. If the gap between the long edges 138 of the mirror 130 and the waveguide plates 57 and 58 is small relative to the wavelength of the microwave energy, this gap will appear to be substantially a short circuit and only a small amount of radiation will leak past the edges. To further reduce energy leakage between the parallel-plate waveguide 56 and the mirror edges 138, the edges preferably define a choke groove in accordance with well-known microwave design practices.

Figure 11B:
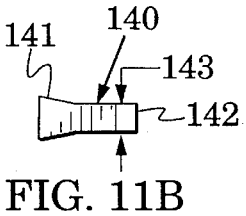
FIG. 11B is a top plan view of the feed horn of FIG. 11A.
Figure 11A:
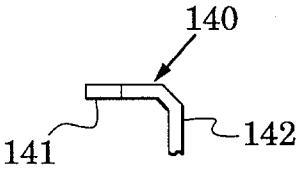
FIG. 11A is a side elevation view of a feed horn in the scanned antenna of FIG. 3.

FIGS. 11A–11B illustrate a conventional waveguide feed horn 140 that includes a horn section 141 at the end of a 90° bend waveguide section 142. The horn 141 is flared to enhance its impedance match with free space. The width 143 of the horn is preferably chosen to aid in achieving a cosine shaped energy density from the reflector 50 of FIGS. 9A–9C. In particular, it should be wide enough to illuminate the end wall 120.

With a description of the reflector 50, the mirror 52 and the radiator 54 in hand, attention is now redirected to the scanned antenna 40 of FIGS. 3 and 4. In the antenna 40, the reflector 50 is positioned at one end of the parallel-plate waveguide 56 and the radiator 54 is positioned at the other end. Between these elements, the mirror 52 is pivotably mounted at its pivot bore 134, e.g., with a pin that extends through the waveguide plates 57 and 58. The mirror 52 can be pivoted by any of various, well-known mechanical structures, e.g., by the urging of a cam 146 against a ball 147 that is mounted to the back of the mirror. The feed horn 140 protrudes through the waveguide plate 57 and is positioned at the focal point 123 of the reflector.

In operation of the antenna 40, a microwave signal is directed through the feed horn 140 and radiated (indicated by incidence ray paths 150) at the parabolically-shaped end wall 120 of the reflector 50. The signal is reflected as collimated microwave energy along reflected ray paths 152. Because of the properties of a parabolic surface, a reflected wavefront 153 will lie in a plane which is orthogonal with the reflected rays 152, i.e., the path distance along each set of rays 150, 152 between the focus 122 and the wavefront 153 is constant.

In FIG. 3, the mirror 52 is set at a 45° angle. Because the angle of incidence $\alpha$ must equal the angle of reflection $\beta$, the relation $\alpha=\beta=45°$ results. Therefore, the microwave energy is redirected along a vertical path 154 and with a redirected wavefront 155 that is horizontal, i.e., the path distance along each ray 152, 154 is constant between the wavefronts 153 and 155. The redirected microwave energy is received into the input port 80 of the radiator 54. It travels upward in the radiator 54 and is radiated from the output aperture 82 as indicated by the radiated rays 156 in FIG. 4. Because the transverse stubs 79 of the aperture 82 are substantially parallel with the input port 80, the wavefront 157 of the radiated rays 156 will be parallel with the stubs 79, i.e., the path distance along any set of rays 154, 156 and through any selected one of the transverse stubs 79 is equal between the wavefronts 155 and 157.

The antenna beam that results from the wavefront 157 is orthogonal to that wavefront. Therefore, as a result of the mirror 52 being positioned at 45°, the antenna beam will be directed along the mechanical boresight 44 in FIG. 1.

Figure 5:
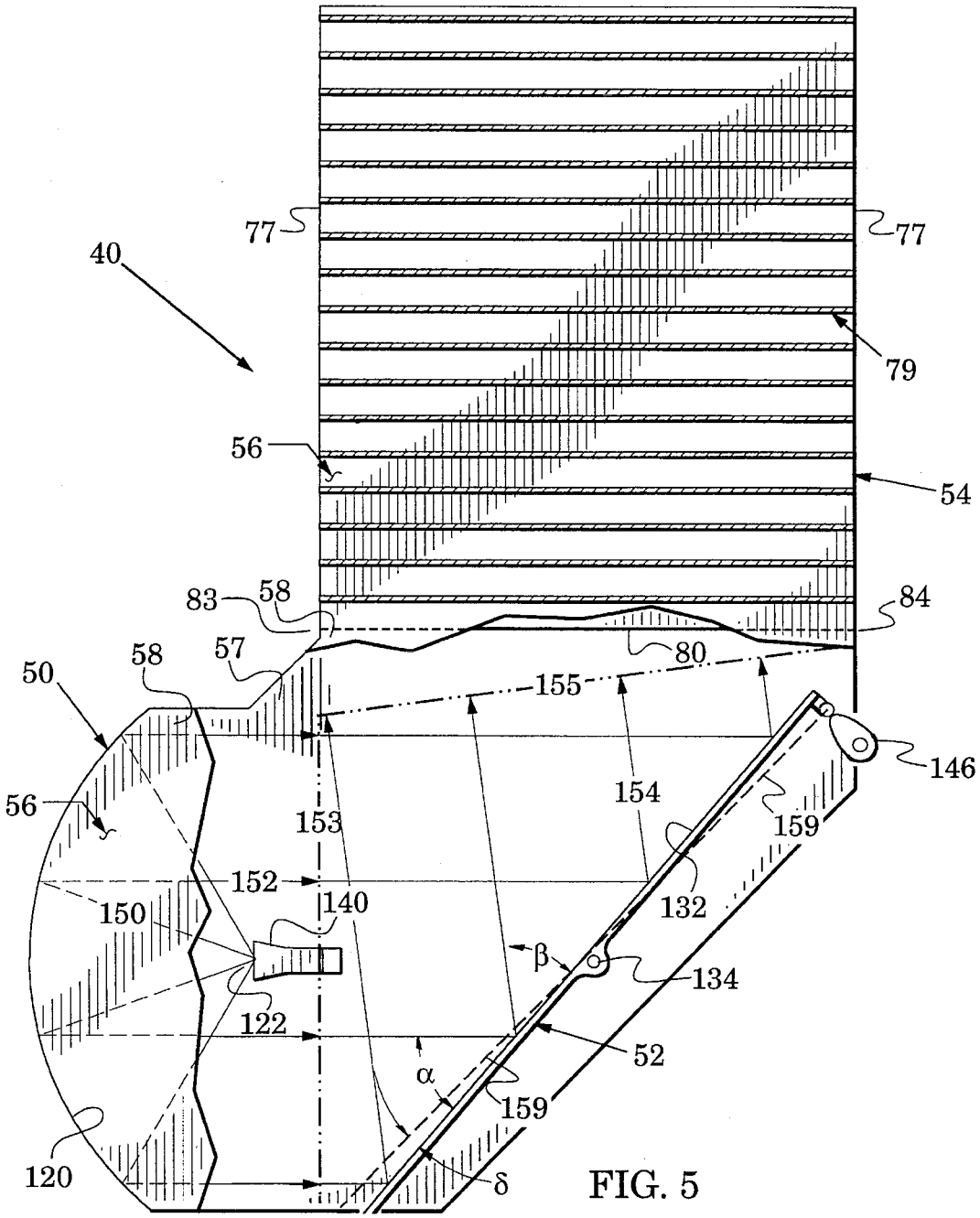
FIG. 5 is a view similar to FIG. 3 showing the antenna mirror in a second position.

In FIG. 5, the mirror 52 has been pivoted counterclockwise by an angle $\delta=3.75°$ from its former 45° position of FIG. 3. The former position is indicated by the broken line 159. The angle of incidence $\alpha$ must now be 48.75°. Because the angle of reflection $\beta$ is also 48.75° and the mirror surface 132 has been rotated 3.75°, the redirected rays 154 and the redirected wavefront 155 are rotated 7.5° from their positions in FIG. 3. Because the path distances along the ray paths 156 between the wavefronts 155 and 157 must be equal (to preserve phase equality), the wavefront 157 is also tilted 7.5°. This will cause the beam radiated from the radiator 54 to be rotated 7.5° from the mechanical boresight 44 in FIG. 1. In FIG. 1, this is indicated by the beam position 42A.

Thus, when the mirror 52 is pivoted back and forth from a median position by an angle $\delta$, the radiated antenna beam 42 (in FIG. 1) will scan back and forth in azimuth by $2\delta$. In the specific case in which $\delta=3.75°$, the scan angle 48 of the antenna beam 42 in FIG. 1 is 15°. The wavefront 157 of the antenna beam rotates because the wavefront 155 is rotated in reference to the input port 80.

Each wavefront 155 and 157 is related to an equivalent phase distribution across its respective port or aperture. For example, the wavefront 155 in FIG. 5 causes a phase distribution across the input port 80 (from one side 83 to the opposite side 84). In response, the radiator 54 generates a phase distribution across the aperture 82 (from one side 77 of the radiator 54 to an opposite side 77). The radiator 54 is configured to cause the phase distribution across its output aperture 82 to be a function, e.g., a linear one-to-one function, of the phase distribution across its input port 80. Therefore, if the phase distribution across the input port 80 is varied, e.g., by pivoting the mirror 52, the antenna beam is scanned.

In accordance with a feature of the invention, the wavefront 155 in FIGS. 3 and 5 is a continuous wavefront whose energy density approximates a cosine function. This wavefront is especially suitable for producing an antenna beam from the radiator 54 that has low side-lobe power. The continuous wavefront can better approximate a cosine function than a wavefront from structures, e.g., a slot array, that form an array of discrete sources.

It should be understood that the direction of microwave energy will be altered by diffraction as it crosses the air-dielectric interface of the input port 80 and the dielectric-air interface of each transverse stub face 74 (shown in FIG. 7C). However, the alteration is equal and opposite across these two interfaces and may, therefore, generally be ignored.

The thickness of the panel 64, as shown in FIGS. 7C–7D, is preferably less than $\lambda_g/2$. This sets the spacing between the plate portions 57A and 58A of the radiator 54. At higher frequencies, this spacing narrows and may cause fabrication and assembly problems if it is maintained in the area of the reflector 50, the feed horn 140 and the mirror 52 (see FIG. 3). Accordingly, the waveguide plate spacing can be greater over these elements and then tapered to the narrower spacing of the portions 57A and 58A as the waveguide 56 approaches the input port 80.

FIGS. 12–17 illustrate another scanned antenna embodiment 160 in which the parallel-plate waveguide 56 of the scanned antenna 40 (shown in FIGS. 3–6) is folded twice to reduce the spatial volume of the antenna. This folding produces three waveguide portions 164, 166 and 168. The portions 164 and 166 are connected by a 180° waveguide bend 170 and the portions 166 and 168 are connected by another 180° waveguide bend 172. The portion 168 is substantially formed by the parallel-plates of the radiator 54.

Figure 14:
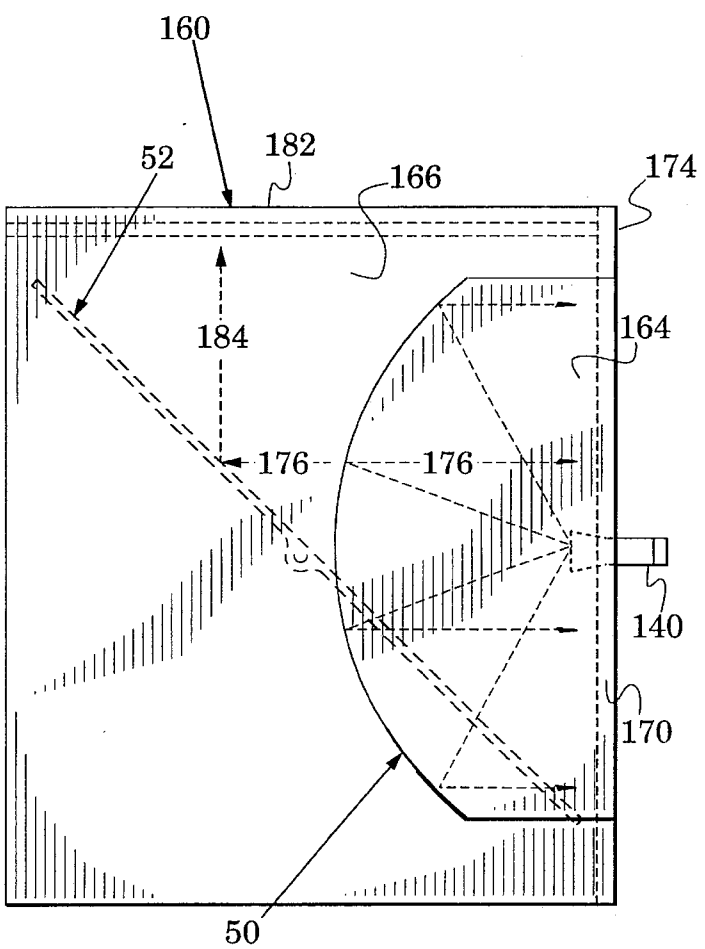
FIG. 14 is a rear elevation view of the scanned antenna of FIG. 12.
Figure 13:
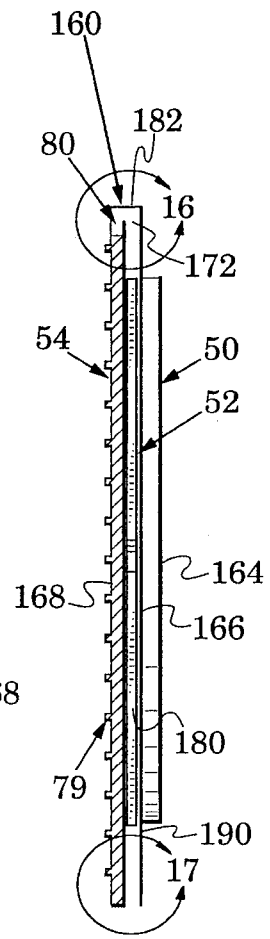
FIG. 13 is a side elevation view of the scanned antenna of FIG. 12.
Figure 12:
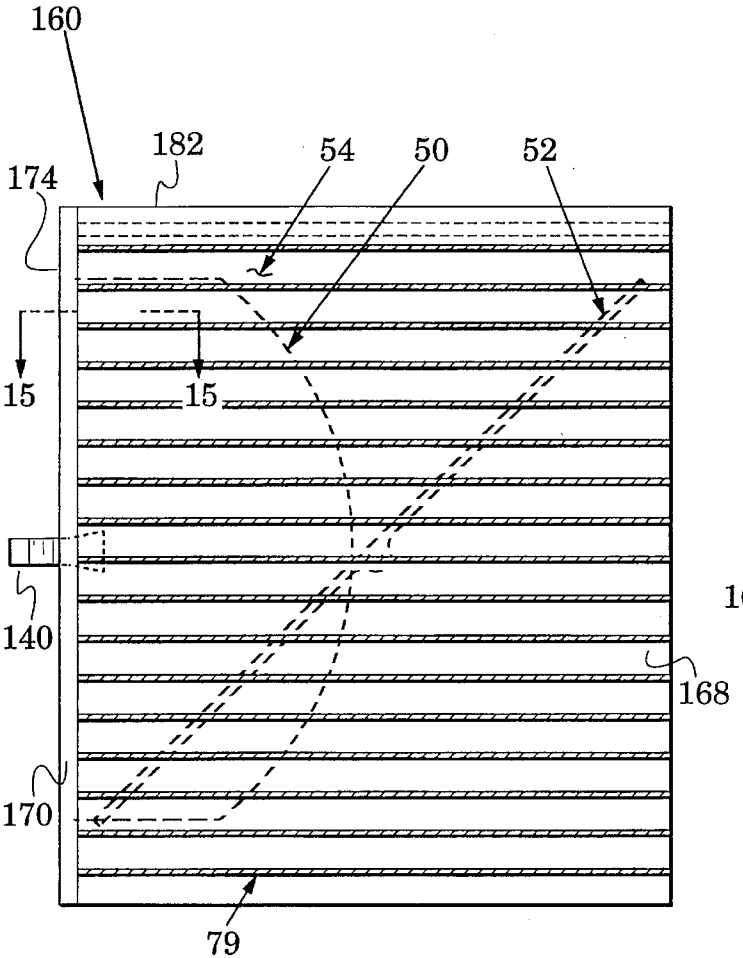
FIG. 12 is a view, similar to FIG. 3, illustrating another scanned antenna embodiment.
Figure 15:
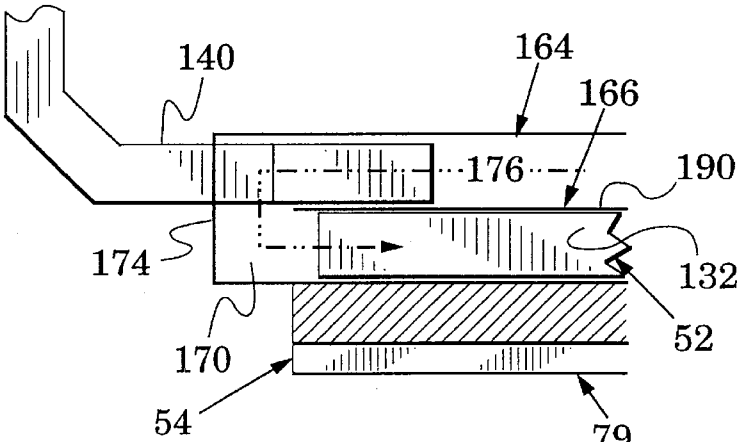
FIG. 15 is an enlarged view along the plane 15—15 of FIG. 12.

FIGS. 12–14 indicate that the reflector 50 is positioned on the rear side of the scanned antenna 160. The parallel-plate waveguide portion 164 connects the reflector 50 with the 180° bend 170 that is positioned at the side 174 of the antenna. As shown in FIG. 15, the feed horn 140 is inserted through this bend 170 to illuminate the reflector 50. The reflected, collimated microwave energy from the reflector 50 flows around the bend 170 as indicated by the radiation ray 176. The ray 176 is then in the waveguide portion 166 which, as shown in FIG. 13, is positioned between the portions 164 and 168. The reflected ray strikes the mirror surface 132 and is redirected along ray paths 184. The reflecting surface 132 of the mirror is visible in FIG. 15 and the back side 180 of the mirror is visible in FIG. 13. The mirror 52 is pivotably mounted in the waveguide portion 166.

Figure 16:
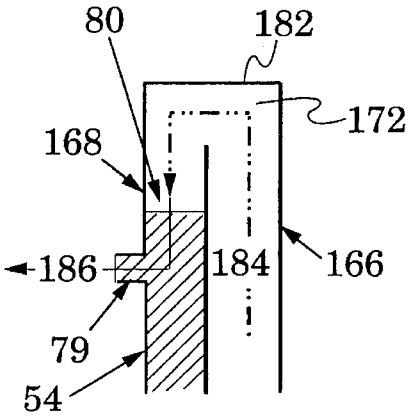
FIG. 16 is an enlarged view of the structure within the curved line 16 of FIG. 13.
Figure 17:
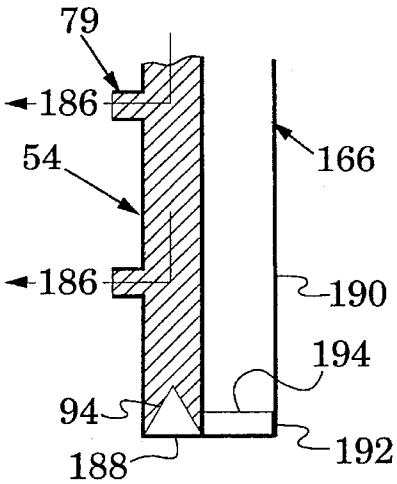
FIG. 17 is an enlarged view of the structure within the curved line 17 of FIG. 13.

The redirected energy from the mirror 52 proceeds upward along the paths 184 through the waveguide portion 166 to the 180° bend 172 which is positioned at the top side 182 of the antenna 160. FIG. 16 illustrates that the redirected energy then flows around the bend 172 as indicated by the radiation arrow 184, and enters the input port 80 of the radiator 54. Relative to its orientation in FIGS. 3 and 5, the radiator 54 has been inverted in the scanned antenna 160 so that the input port 80 is at the top of the antenna. As shown in FIGS. 16 and 17, the radiation 184 then is radiated as radiation portions 186 out of each of the transverse stubs 79. FIG. 17 shows that an absorptive load 94 is positioned at the end 188 of the radiator 54 to reduce reflections that might otherwise alter the magnitude of the radiated portions 186.

A waveguide plate 190 is positioned between, and forms a part of, waveguide portions 164 and 166. The lower part 192 of this plate is shown to be unsupported in FIG. 13. Accordingly, structure can be placed between it and the rear plate of the radiator 54 to physically stabilize the plate 190. An exemplary structure is a dielectric block 196 that is shown in FIG. 17.

The operation of the scanned antenna 160 is similar to that of the scanned antenna 40 of FIGS. 3–11. Pivoting the reflector 52 causes a wavefront which enters the input port 80 and a wavefront that exits the transverse stubs 79 to pivot in response. Consequently, the antenna beam that is formed by the radiation portions 186 of FIGS. 16 and 17, is scanned back and forth.

Another scanned antenna embodiment 200 is shown in FIGS. 18–21. The antenna 200 includes a parallel-plate wave guide that is folded once to reduce the antenna's spatial volume. The folding produces two waveguide portions 202 and 204 which are connected by a 180° waveguide bend 206. The waveguide bend 206 is positioned at the upper edge 207 of the antenna. The waveguide portion 204 is substantially formed by the parallel-plates of a radiator 54.

The scanned antenna 200 also includes a reflector 210 which is illustrated in FIGS. 21A–21C. The reflector 210 is similar to the reflector 52 of FIGS. 9A–9C with like elements indicated by like reference numbers. However, the reflector's parabolic face 120 is carried on a single side plate 212. A pivot bore 214 is formed in the plate 206 at the focus of the parabolic face 120. Another pivot bore 215 is formed at the apex 216 of the parabolic face 120. Thus, the reflector 210 can be pivoted about either its parabolic focus or about the parabolic apex. Alternatively, the reflector need only define one pivot bore if the desired pivot point has been predetermined.

Figure 20:
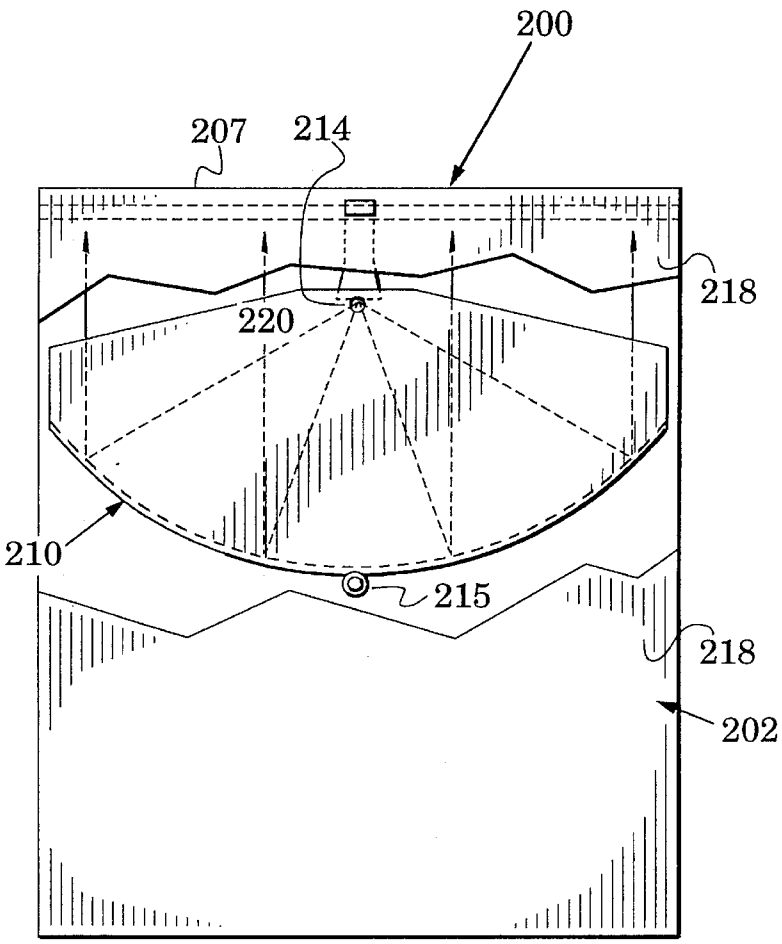
FIG. 20 is a rear elevation view of the scanned antenna of FIG. 18.
Figure 19:
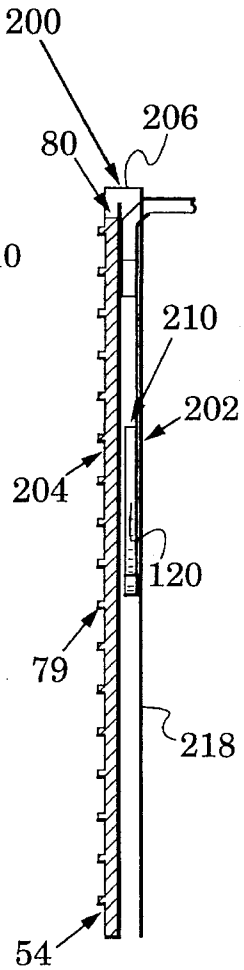
FIG. 19 is a side elevation view of the scanned antenna of FIG. 18.
Figure 18:
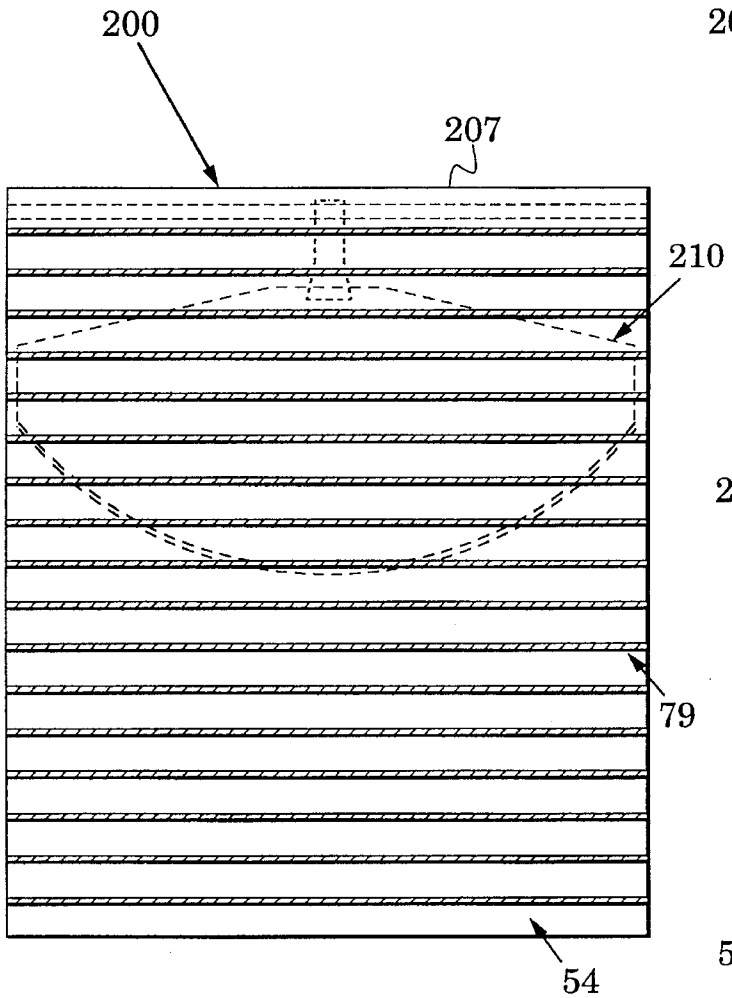
FIG. 18 is a view, similar to FIG. 3, illustrating another scanned antenna embodiment.

FIGS. 18–20 show that the reflector 210 is pivotably mounted in the waveguide portion 202. A feed horn 140 protrudes through a wall 218 of the waveguide portion 202 to illuminate the reflector 210 from its focus. The wall 218 is partially removed in FIG. 20 for clarity of illustration. The reflected energy travels upward along reflected rays 220 to the 180° waveguide bend 206. The waveguide bend 206 redirects the energy into the input port 80 of the radiator 54. The energy flows within the radiator and exits the transverse stubs 79 in a manner described hereinbefore relative to FIGS. 3–6 and 12–14.

The reflector 210 is preferably pivotably mounted about its focus, e.g., by a pin through its pivot bore 214. It can also be pivotably mounted by a pin through the pivot bore 215 at its parabolic apex 216. The latter pivotable mounting will cause a certain amount of aberration with consequent increase in side-lobe energy of the antenna beam. In either case, the feed horn 140 can remain in a fixed arrangement, or alternatively, can be pivoted with the reflector 210. The latter arrangement can be realized by bringing the microwave signal into the feed horn 140 through a rotary waveguide structure.

In the antenna embodiments 40, 160 and 200, a small amount of microwave energy will be lost because reflected energy from the parabolic surface of the reflector (50 or 210) is intercepted by the feed horn 140, e.g., see FIG. 3. Accordingly, the reflector structure may be replaced with a folded reflector such as the reflector 230 that is shown in FIGS. 22A–22C. The reflector 230 is similar to the reflector 50 of FIGS. 9A–9C with like elements indicated by like reference numbers.

However, the reflector 230 is widened so as to receive a septum 232 between its parallel plates 57B and 58B. The septum 232 is spaced from the parabolic wall 120 and divides the interior of the reflector 230 into a lower and an upper chamber 234 and 236 as shown in FIG. 22C. The feed horn 140 (shown in FIG. 3) can now be positioned to illuminate the lower chamber 234. The reflected radiation from the parabolic wall 120 will "wrap around" the septum 232 and exit the upper chamber 236. Thus, the feed horn 140 is removed from the path of the reflected radiation.

As shown in FIG. 7A, the radiator 54 has an output aperture 82 with a width 68 and a height 85. The illustrated aspect ratio is only for illustrative purposes. The actual aspect ratio must be adjusted appropriately for each application of the teachings of the invention. For example, an exemplary scanned antenna realized as part of a collision-avoidance radar for the motor vehicle 38 of FIGS. 1 and 2, preferably has an antenna beam 42 that is narrower in its azimuth plane than in its elevation plane.

Because beam width is inversely proportional to aperture dimension, an aperture directed to this application would have a width 68 that is greater than its height 85. If the collision-avoidance radar were designed for a radiated frequency in the range of 77 GHz, exemplary dimensions 68 and 85 in FIG. 7A would be 20 and 10 centimeters respectively. This aperture could conveniently fit behind a license plate which would be preferably made of a low-loss material, e.g., plastic. Alternatively, the aperture and license plate could be positioned along side each other.

Scanned antennas in accordance with the present invention have few parts, require only a single moving part and can be fabricated with simple techniques. For example, the radiator 54 can be fabricated by shaping its core 62 from a low-loss dielectric and then metallically plating appropriate core portions to realize the parallel-plate waveguide and its transverse stubs. Due to the absence of interior details, this fabrication technique requires metallization only on exterior surfaces with an absence of stringent requirements on metallization thickness, uniformity or masking. Mirrors and reflectors taught by the invention may also be fabricated by this method. The mirror 52 which is illustrated in FIG. 3 is light weight with a low inertia that facilitates its pivoting action. It can be pivoted about its center as shown or about other portions, e.g., either end.

Although scanned antenna beams have been realized, in illustrated embodiments, with rotation of mirrors and reflectors with reference to a fixed radiator, it should be realized that such rotation is relative, and other embodiments can be realized in an opposite manner, i.e., rotation of the radiator with respect to other fixed antenna elements.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A scanned antenna for converting a microwave signal into a scanned antenna beam, comprising:

a reflector configured to reflect said microwave signal along a first signal path as a reflected microwave signal;

a mirror positioned to redirect said reflected microwave signal along a second signal path; and a radiative member formed with a parallel-plate waveguide which has an input port and further formed with a plurality of parallel-plate stubs which issue transversely from said parallel-plate waveguide to form an output aperture which radiates microwave energy that is received through said input port as an antenna beam wherein said antenna beam has a phase distribution across said output aperture that is a function of the phase distribution of said microwave energy across said input port;

wherein said radiative member is positioned to intersect said second signal path with said input port;

and wherein at least one of said reflector, said mirror and said radiative member is adapted to pivot and thereby cause the angular relationship between said second signal path and said input port to vary over a predetermined angular range.

2. The scanned antenna of claim 1, wherein said reflector is a parabolic reflector which is configured to cause said reflected microwave signal to be a collimated microwave signal with a constant phase along any plane that is substantially orthogonal with said first signal path.

3. The scanned antenna of claim 2, wherein said parabolic reflector is a pillbox antenna.

4. The scanned antenna of claim 2, wherein said parabolic reflector is a folded pillbox antenna.

5. The scanned antenna of claim 1, wherein said mirror is formed with a substantially flat reflective surface.

6. The scanned antenna of claim 1, wherein said mirror is adapted to pivot and said reflector and said radiative member are fixed.

7. The scanned antenna of claim 1, wherein said reflector is adapted to pivot and said mirror and said radiative member are fixed.

8. A scanned antenna for converting a microwave signal into a scanned antenna beam, comprising:

a reflector configured to reflect said microwave signal along a first signal path as a reflected microwave signal;

a mirror positioned to redirect said reflected microwave signal along a second signal path; and a radiative member formed with an input port and an output aperture and configured to radiate microwave energy that is received through said input port as an antenna beam from said output aperture;

wherein:

said radiative member includes a parallel-plate waveguide which is configured to define said input port and a plurality of parallel-plate stubs that are arranged to issue from said parallel-plate waveguide and define said output aperture;

said antenna beam has a phase distribution across said output aperture that is a function of the phase distribution of said microwave energy across said input port;

said radiative member is positioned to intersect said second signal path with said input port; and at least one of said reflector, said mirror and said radiative member is adapted to pivot and thereby cause the angular relationship between said second signal path and said input port to vary over a predetermined angular range.

9. The scanned antenna of claim 8, further including a dielectric core configured to carry said parallel-plate waveguide and said parallel-plate stubs.

10. A scanned antenna for converting a microwave signal into a scanned antenna beam, comprising:

a reflector configured to reflect said microwave signal along a first signal path as a reflected microwave signal;

a mirror positioned to redirect said reflected microwave signal along a second signal path; and a continuous transverse stub structure formed with an input port and an output aperture and configured to radiate microwave energy that is received through said input port as an antenna beam from said output aperture wherein said antenna beam has a phase distribution across said output aperture that is a function of the phase distribution of said microwave energy across said input port;

wherein said continuous transverse stub structure is positioned to intersect said second signal path with said input port;

and wherein at least one of said reflector, said mirror and said continuous transverse stub structure is adapted to pivot and thereby cause the angular relationship between said second signal path and said input port to vary over a predetermined angular range.

11. A scanned antenna for converting a microwave signal into a scanned antenna beam, comprising:

a parallel-plate waveguide haying first and second portions;

a plurality of parallel-plate stubs issuing transversely from said first portion to form an antenna aperture;

said second portion adapted to form a reflector which reflects said microwave signal along a first signal path as a reflected microwave signal; and a mirror pivotably mounted within said parallel-plate waveguide and positioned between said reflector and said first portion to redirect said reflected microwave signal along a second signal path into said first portion.

12. A scanned antenna for converting a microwave signal into a scanned antenna beam, comprising:

a parallel-plate waveguide which has first and second portions;

a plurality of parallel-plate stubs that are arranged to issue from said first portion to form an antenna aperture;

a reflector positioned within said second portion to reflect said microwave signal along a first signal path as a reflected microwave signal; and a mirror pivotably mounted within said parallel-plate waveguide and positioned to redirect said microwave signal along a second signal path into said first portion.

13. The scanned antenna of claim 12, further including a dielectric core configured to fill said first portion and said parallel-plate stubs.

14. The scanned antenna of claim 12, wherein said parallel-plate waveguide is configured to form a 180° bend between said first and second portions.

15. A scanned antenna for converting a microwave signal into a scanned antenna beam, comprising:

a reflector configured to reflect said microwave signal along a signal path as a reflected microwave signal; and a radiative member formed with a parallel-plate waveguide which has an input port and further formed with a plurality of parallel-plate stubs which issue transversely from said parallel-plate waveguide to form an output aperture which radiates microwave energy that is received through said input port as an antenna beam wherein said antenna beam has a phase distribution across said output aperture that is a function of the phase distribution of said microwave energy across said input port;

wherein said radiative member is positioned to intersect said signal path with said input port;

and wherein at least one of said reflector and said radiative member is adapted to pivot and thereby cause the angular relationship between said second signal path and said input port to vary over a predetermined angular range.

16. The scanned antenna of claim 15, wherein said reflector is a parabolic reflector which is configured to cause said reflected microwave signal to be a collimated microwave signal with a constant phase along any plane that is substantially orthogonal with said signal path.

17. The scanned antenna of claim 15, wherein said parabolic reflector is a pillbox antenna.

18. The scanned antenna of claim 15, wherein said parabolic reflector is a folded pillbox antenna.

19. The scanned antenna of claim 15, wherein said reflector is adapted to pivot and said radiative member is fixed.

20. A scanned antenna for converting a microwave signal into a scanned antenna beam, comprising:

a reflector configured to reflect said microwave signal along a signal path as a reflected microwave signal; and a radiative member formed with an input port and an output aperture and configured to radiate microwave energy received through said input port as an antenna beam from said output aperture;

wherein:

said radiative member includes a parallel-plate waveguide which is configured to define said input port and a plurality of parallel-plate stubs that are arranged to issue from said parallel-plate waveguide and define said output aperture;

said antenna beam has a phase distribution across said output aperture that is a function of the phase distribution of said microwave energy across said input port;

said radiative member is positioned to intersect said signal path with said input port; and at least one of said reflector and said radiative member is adapted to pivot and thereby cause the angular relationship between said second signal path and said input port to vary over a predetermined angular range.

21. The scanned antenna of claim 20, further including a dielectric core configured to carry said parallel-plate waveguide and said parallel-plate stubs.

22. A scanned antenna for converting a microwave signal into a scanned antenna beam, comprising:

a reflector configured to reflect said microwave signal along a signal path as a reflected microwave signal; and a continuous transverse stub structure formed with an input port and an output aperture and configured to radiate microwave energy received through said input port as an antenna beam from said output aperture wherein said antenna beam has a phase distribution across said output aperture that is a function of the phase distribution of said microwave energy across said input port;

wherein said continuous transverse stub structure is positioned to intersect said signal path with said input port;

and wherein at least one of said reflector and said continuous transverse stub structure is adapted to pivot and thereby cause the angular relationship between said second signal path and said input port to vary over a predetermined angular range.

23. A scanned antenna for converting a microwave signal into a scanned antenna beam, comprising:

a parallel-plate waveguide having first and second portions;

a plurality of parallel-plate stubs issuing transversely from said first portion to form an antenna aperture; and a pivotable reflector which is positioned to reflect said microwave signal into said first portion;

wherein said second portion is extended over said reflector.

24. A scanned antenna for converting a microwave signal into a scanned antenna beam, comprising:

a parallel-plate waveguide which has first and second portions;

a plurality of parallel-plate stubs that are arranged to issue from said first portion to form an antenna aperture; and a reflector pivotably positioned within said second portion to reflect said microwave signal into said first portion.

25. The scanned antenna of claim 24, further including a dielectric core configured to fill said first portion and said parallel-plate stubs.

26. The scanned antenna of claim 24, wherein said parallel-plate waveguide is configured to form a 180° bend between said first and second portions.

27. A collision-avoidance system for generating a scanned antenna beam from a microwave signal, comprising:

a motor vehicle; and a scanned antenna carried on said vehicle wherein said antenna includes:

a) a reflector configured to reflect said microwave signal along a first signal path as a reflected microwave signal;

b) a mirror positioned to redirect said reflected microwave signal along a second signal path; and c) a radiative member formed with a parallel-plate waveguide which has an input port and further formed with a plurality of parallel plate stubs which issue transversely from said parallel-plate waveguide to form an output aperture which radiates microwave energy that is received through said input port as an antenna beam wherein said antenna beam has a phase distribution across said output aperture that is a function of the phase distribution of said microwave energy across said input port;

wherein said radiative member is positioned to intersect said second signal path with said input port;

and wherein at least one of said reflector and said mirror is adapted to pivot and thereby cause the angular relationship between said second signal path and said input port to vary over a predetermined angular range.

28. A collision-avoidance system for generating a scanned antenna beam from a microwave signal, comprising:

a motor vehicle; and a scanned antenna carried on said vehicle wherein said antenna includes:

a) a reflector configured to reflect said microwave signal along a signal path as a reflected microwave signal; and b) a radiative member formed with a parallel-plate waveguide which has an input port and further formed with a plurality of parallel-plate stubs which issue transversely from said parallel-plate waveguide to form an output aperture which radiates microwave energy that is received through said input port as an antenna beam wherein said antenna beam has a phase distribution across said output aperture that is a function of the phase distribution of said microwave energy across said input port;

wherein said radiative member is positioned to intersect said signal path with said input port;

and wherein at least one of said reflector and said radiative member is adapted to pivot and thereby cause the angular relationship between said second signal path and said input port to vary over a predetermined angular range.

* * * * *